US006312293B1

(12) United States Patent
Wang

(10) Patent No.: US 6,312,293 B1
(45) Date of Patent: Nov. 6, 2001

(54) RECEPTACLE CONNECTOR HAVING AN ANTI-MISMATING MEANS

(75) Inventor: Suiya Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 68 days.

(21) Appl. No.: 09/721,827

(22) Filed: Nov. 22, 2000

(30) Foreign Application Priority Data

Aug. 24, 2000 (TW) ..... 89214679 U

(51) Int. Cl.[7] ..... H01R 13/64

(52) U.S. Cl. ..... 439/677; 439/676; 439/607; 439/680

(58) Field of Search ..... 439/677, 680, 439/681, 674, 607, 676, 344; D14/256

(56) References Cited

U.S. PATENT DOCUMENTS 4,878,858 * 11/1989 Dechelette ..... 439/680

6,186,835 * 2/2001 Cheshire ..... 439/677

* cited by examiner

*Primary Examiner*—Tho D. Ta
(74) *Attorney, Agent, or Firm*—Wei Te Chung

(57) ABSTRACT

A receptacle connector includes an insulative housing (1) having an upper wall (18) a bottom face (15), and two sidewalls (17), with areceiving space (10) defined therebetween. The upper wall defines a passageway (11) and the sidewalls each define a recess (14). A pair of anti-mismating latches (4) is attached in the insulative housing. Each latch includes a connecting arm (42), a resilient arm (41), and a baffle (44) extending from the resilient arm. In assembly, the resilient arm is received in the corresponding recess, and the baffle includes a free end projecting into the receiving space. In mating, a complementary plug connector (20) presses the connecting arms outwardly, causing the baffles to retract from the receiving space into the recesses, allowing the complementary plug connector to be fully inserted.

11 Claims, 9 Drawing Sheets

RECEPTACLE CONNECTOR HAVING AN ANTI-MISMATING MEANS

BACKGROUND OF THE INVENTION

1. Field of the Invention

The present invention relates to a receptacle connector, and particularly to a receptacle connector which has an anti-mismating means for preventing incorrect insertion of a non-complementary plug connector 2. Description of the Related Art Both RJ-45 connector assemblies and RJ-11 connector assemblies are generally used in signal transmission networks. Each RJ-45 connector assembly and each RJ-11 connector assembly includes a plug connector and a corresponding receptacle connector. When mating, the plug connector is inserted into the corresponding receptacle connector. However, the main difference between an RJ-45 plug connector and an RJ-11 plug connector, or an RJ-45 receptacle connector and an RJ-11 receptacle connector, is that the dimensions of the RJ-45 plug connector and RJ-45 receptacle connector are larger than those of the respective RJ-11 plug connector and RJ-11 receptacle connector. Thus, an RJ-11 plug connector may be mistakenly inserted into an RJ-45 receptacle connector, which may result in damage to the RJ-45 receptacle connector.

In order to prevent mismating, co-pending U.S. patent application Ser. No. 09/536,165, which is assigned to the same assignee of the present application, discloses an RJ-45 receptacle connector (see FIG. 8). The RJ-45 receptacle connector 51 comprises an insulative housing 53 and an anti-mismating device 55. The insulative housing 53 has a mating face 57 and a receiving space 59. The device 55 includes a base portion 61, two resilient hinges 63 extending rearwardly from the base portion 61, and a baffle 65 connecting the two resilient hinges 63. The two hinges 63 are spaced a distance D from each other which is larger than the width of an RJ-11 plug connector. The baffle 65 will prevent an RJ-11 plug connector from being inserted into the RJ-45 receptacle connector 51, thereby preventing a mismating of an RJ-11 plug connector with the receptacle connector. Only a complementary RJ-45 plug connector (not shown) can simultaneously press the two resilient hinges 63, and further push the baffle 65 down allowing insertion into the RJ-45 receptacle connector 51. However, this design of the RJ-45 receptacle connector require a larger receiving space to accommodate the device 55, which does not comply with the current miniaturization trend in the connector field. Another copending application Ser. No. 09/698,699 filed Oct. 27, 2000 with the same assignee also discloses the similar product with relatively large dimensions, similarly requiring further maniaturization/simplicity improvement.

Hence, an improved receptacle connector is required to overcome the disadvantages of the prior art.

BRIEF SUMMARY OF THE INVENTION

The main object of the present invention is to provide a receptacle connector having an anti-mismating means, wherein the receptacle connector need not have enlarged dimensions to receive the means.

In order to achieve the object set forth, a receptacle connector of the present invention includes an insulative housing having an upper wall, a bottom face, and two sidewalls, with areceiving space defined therebetween for receiving a complementary plug connector. The upper wall defines a passageway and the sidewalls each defines a recess therein in communication with the receiving space. A plurality of terminals is received in the receiving space for mating with the plug connector. An anti-mismating means, which is in the form of a pair of latches, is attached in the insulative housing. Each of the latches includes a connecting arm and a resilient arm extending into one of recesses of the sidewall, and a baffle extending from the resilient arm and into the receiving space. In mating, a complementary plug connector pushes the connecting arms outwardly causing the baffles to move from the receiving space into the recesses, allowing the complementary plug connector to be fully inserted.

Other objects, advantages and novel features of the invention will become more apparent from the following detailed description of the present embodiment when taken in conjunction with the accompanying drawings.

DETAILED DESCRIPTION OF THE PREFERRED EMBODIMENTS

Figure 1:
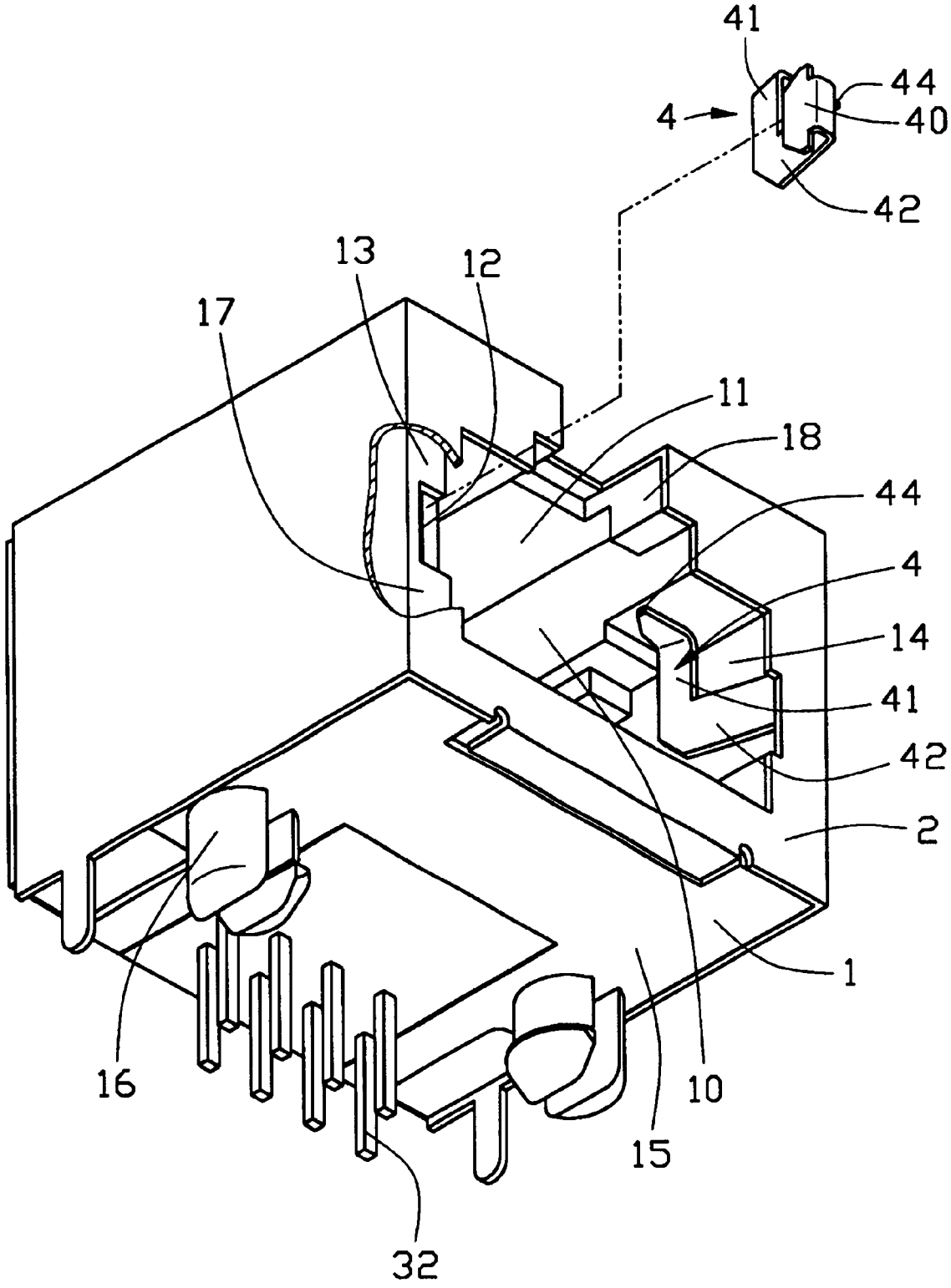
FIG. 1 is a perspective view of a receptacle connector having a pair of anti-mismating latches in accordance with the present invention.
Figure 2:
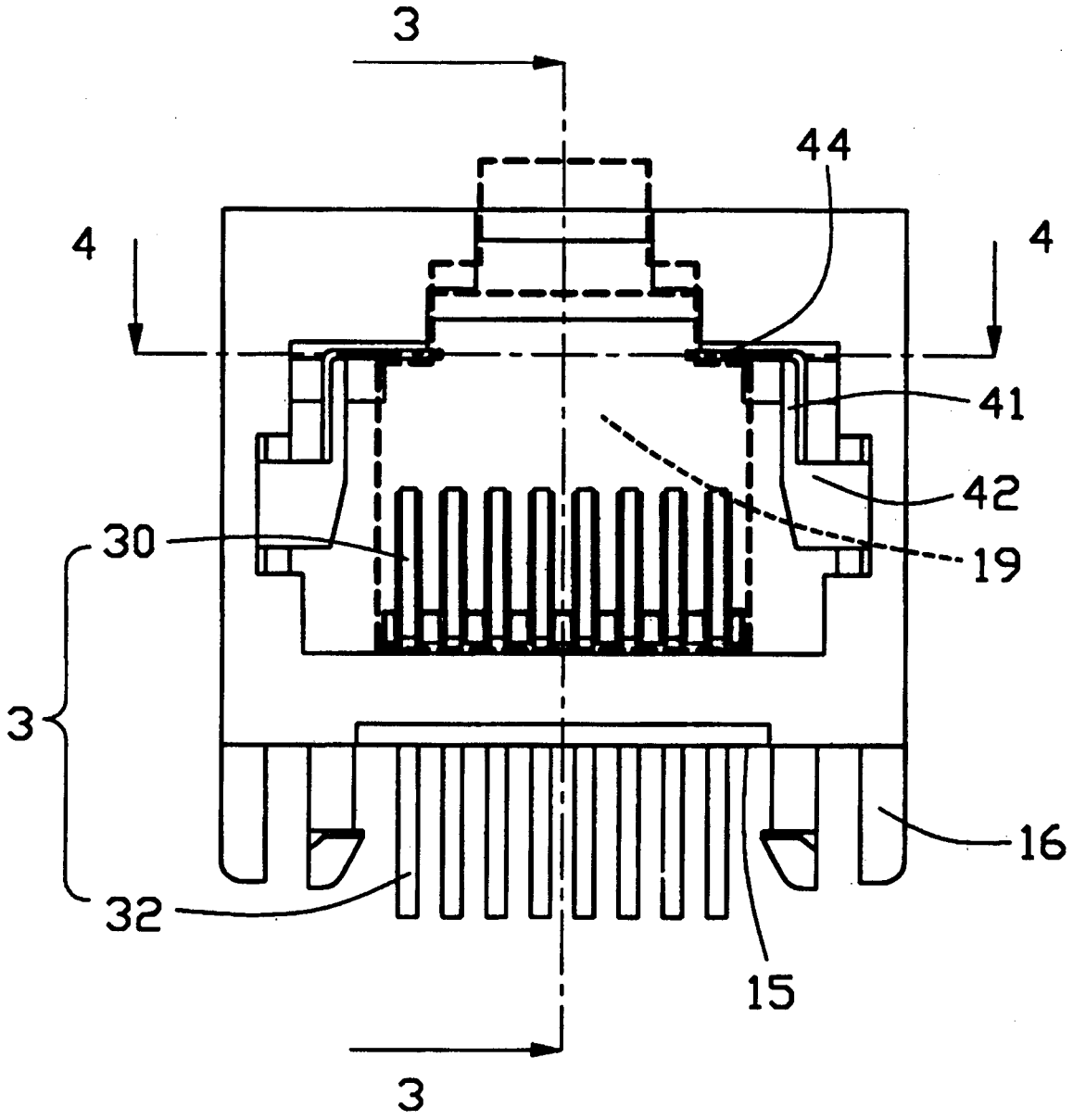
FIG. 2 is a front view of the receptacle connector shown in FIG. 1 with an outline of a non-complementary plug connector shown in broken lines.

Referring to FIGS. 1 and 2, an RJ-45 receptacle connector in accordance with the present invention comprises an insulative housing 1 receiving a plurality of terminals 3, a conductive shell 2 enclosing the insulative housing 1, and a pair of anti-mismating latches 4 assembled in the insulativehousing 1.

The insulative housing 1 defines a mating face 13, a bottom face 15 for mounting to a printed circuit board (PCB, not shown), an upper wall 18, and two sidewalls 17 defining a receiving space 10 therebetween. A pair of posts 16 downwardly extends from the bottom face 15 for positioning the receptacle connector on the PCB. A passageway 11 is defined in a middle portion of the upper wall 18, and a pair of recesses 14 is defined in two sidewalls 17. The passageway 11 and the two recesses 14 are each in communication with the receiving space 10. A pair of slots 12 is defined in the two sidewalls 17 adjacent to the recesses 14.

Figure 3:
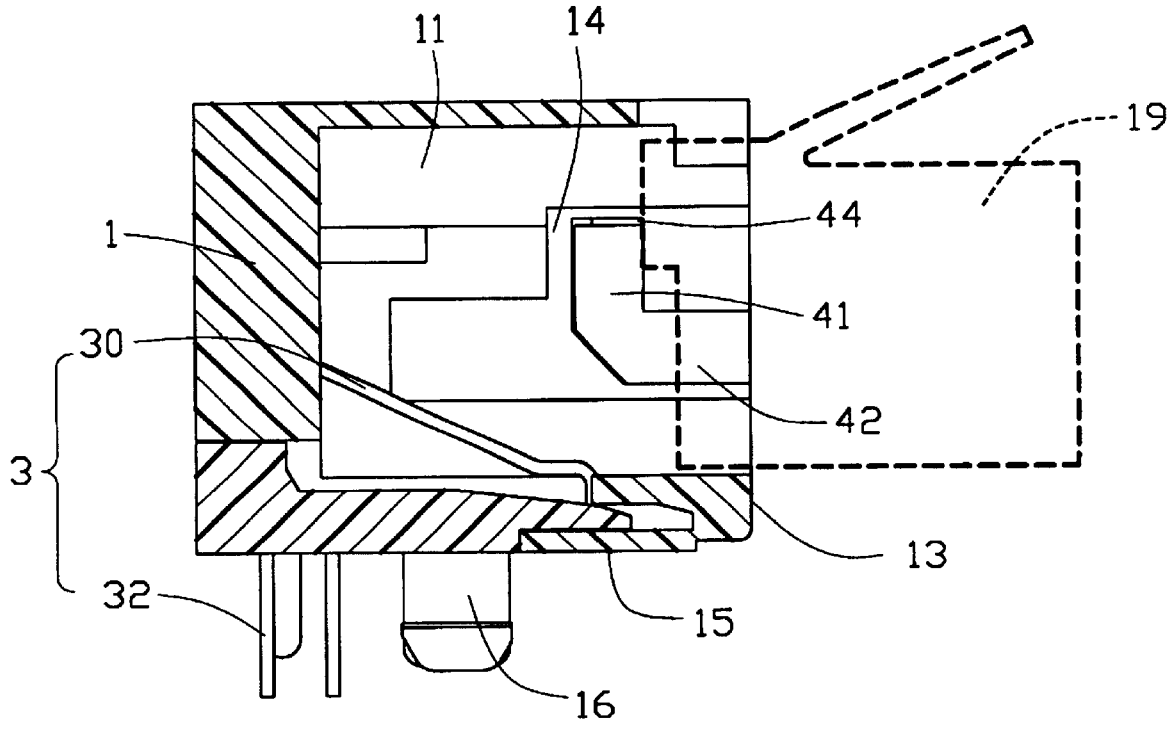
FIG. 3 is a cross-sectional view taken along line 3—3 of FIG. 2.

Referring to FIG. 3, each terminal 3 includes a contacting section 30 at one end for contacting with a mating contact of a complementary plug connector inserted into the receiving space 10, and a soldering section 32 at the other end. The soldering section 32 extends through the bottom face 15 for being soldered to the PCB, thereby establishing an electrical connection between the receptacle connector and the PCB.

Referring to FIGS. 6A–6D, each anti-mismating latch 4 is formed with a base portion 40 at an outer side thereof, a linking portion 43 bent from a front edge of and perpendicular to the base portion 40, a connecting arm 42 bent rearwardly from an inner edge of the linking portion 43 and inclining away from the plane of the base portion 40, a resilient arm 41 upwardly extending from a rear portion of the connecting arm 42, and a baffle 44 bent horizontally and inwardly from an upper edge of the resilient arm 41. A pair of ears 45 project from two opposite sides of the base portion 40, respectively.

Referring back to FIG. 1, in assembly, the base portion 40 of each anti-mismating latch 4 is inserted into a corresponding slot 12 of the insulative housing 1, with the ears 45 having an interferential fit with a corresponding sidewall 17 for securely fixing the anti-mismating latch 4 in the insulative housing 1. The linking portion 43 fits substantially parallel to the mating face 13. The connecting arm 42, the resilient arm 41 and the baffle 44 of each anti-mismating latch 4 are received in a corresponding recess 14 in the housing 1. Since the connecting arm 42 is not parallel to the base portion 40, but rather inclines inwardly relative to the base portion 40, a free end of the baffle 44 projects inwardly into the receiving space 10. The shell 2 can then optionally be assembled to enclose the housing.

Figure 4:
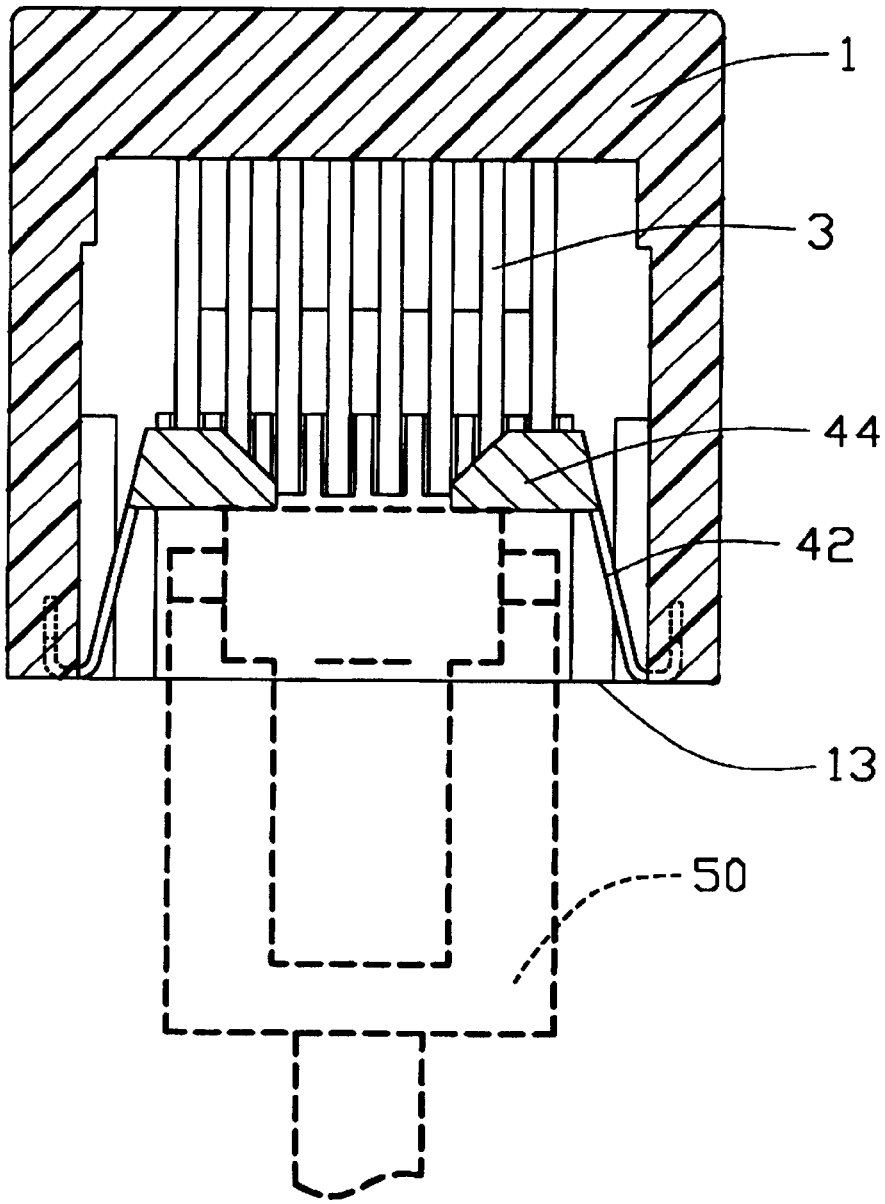
FIG. 4 is a cross-sectional view taken along line 4—4 of FIG. 2.
Figure 5:
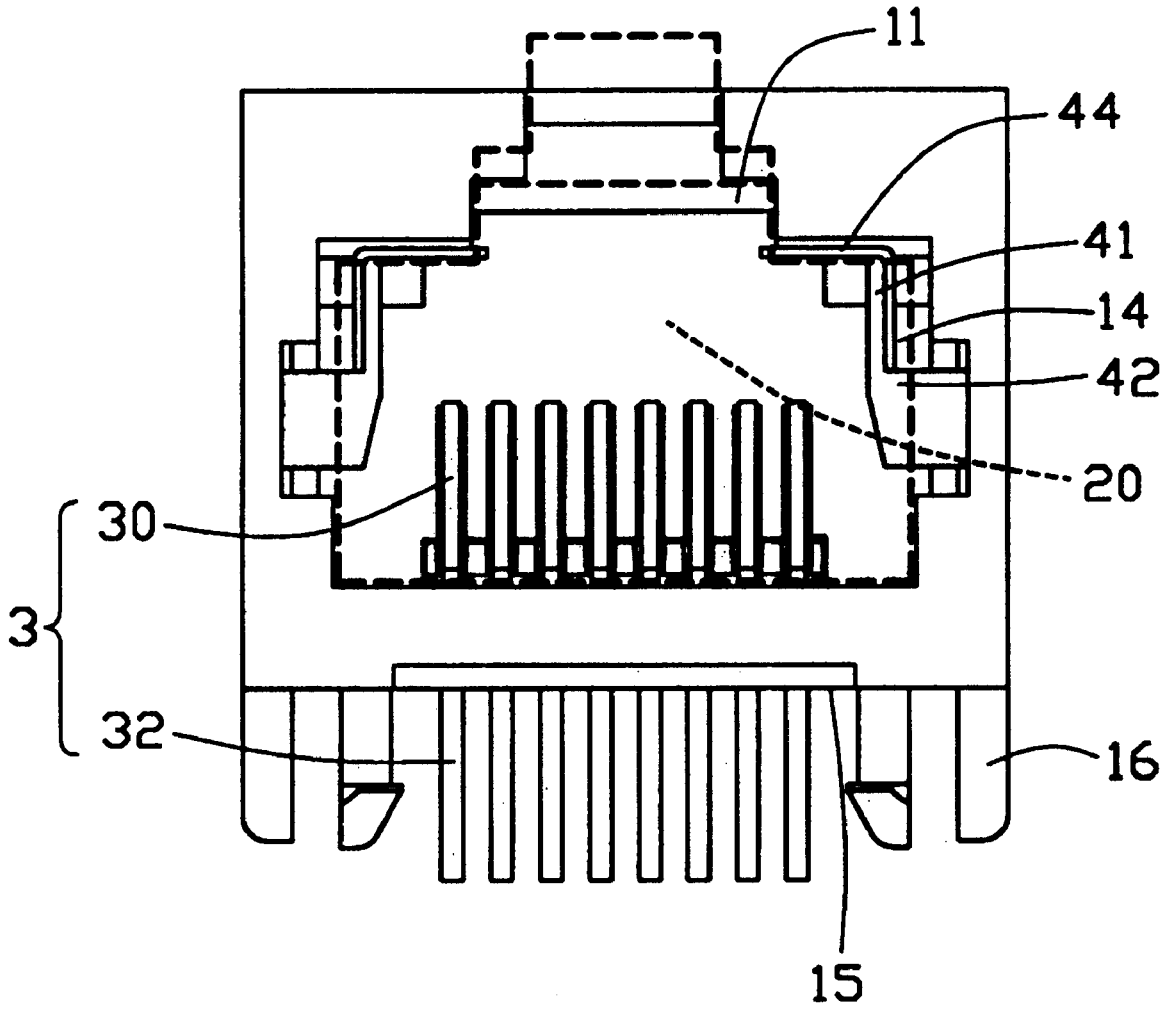
FIG. 5 is a front view of the receptacle connector shown in FIG. 1 with a complementary plug connector shown in broken lines, wherein the plug connector is prepared to mate with the receptacle connector.
Figure 6A:
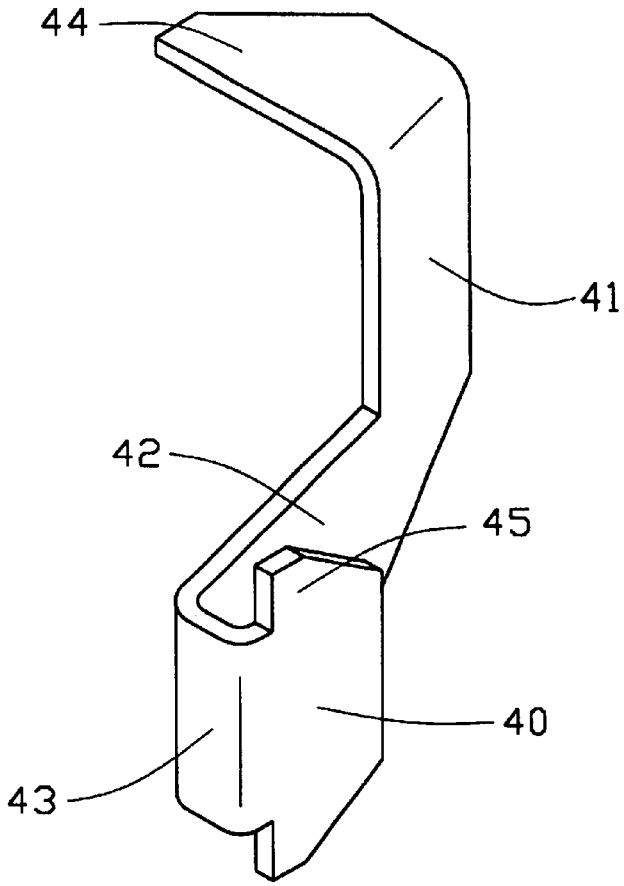
FIG. 6A is a perspective view of the anti-mismating latch in accordance with the present invention.
Figure 6B:
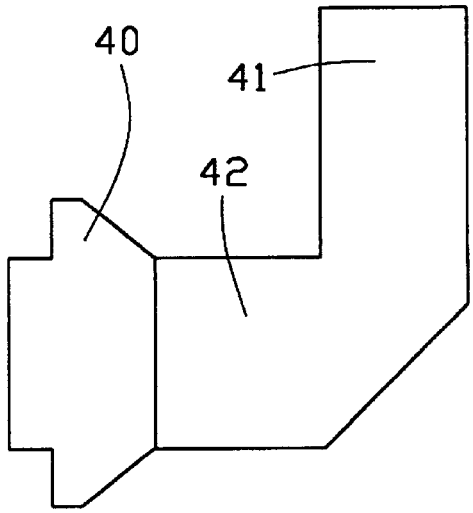
FIGS. 6B–6D are respectively side, top and front views of the anti-mismating latch shown in FIG. 6A.
Figure 6C:
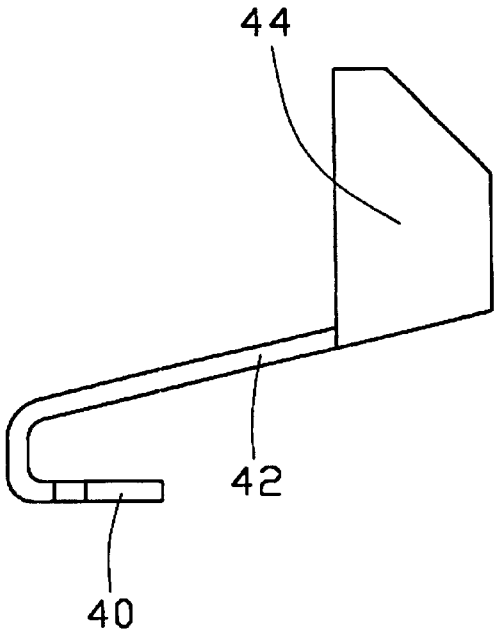
Figure 6D:
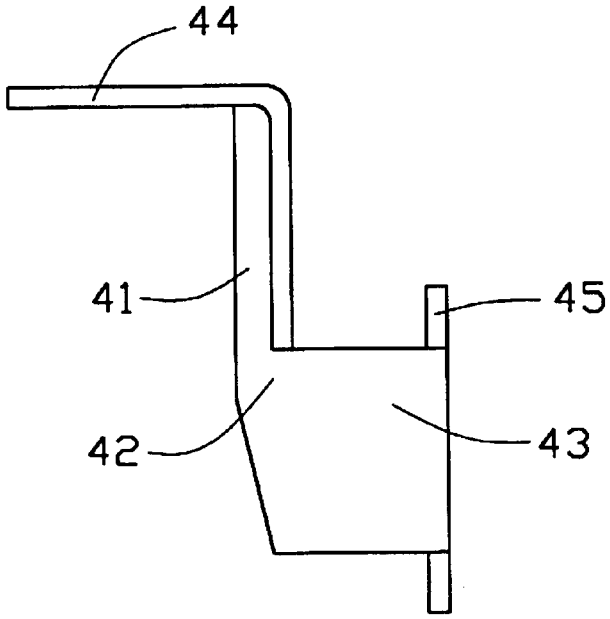

Referring to FIGS. 2–4, the upper portion of an RJ-11 plug connector has a width narrower than the overall width of the receiving space 10 plus the two recesses 14. Instead, the width of an RJ-11 plug connector is approximately equal to that of the receiving space 10. Therefore, when the non-complementary RJ-11 plug connector 19 is mistakenlyinserted into the RJ-45 receptacle connector. Full insertion will be prevented by the free ends of the baffles 44 extending into the receiving space 10. In contrast, as is shown in FIG. 5, an RJ-45 plug connector 20 has a width substantially equal to the overall width of the receiving space 10 plus the two recesses 14. Therefore, when the RJ-45 plug connector 20 is inserted into the RJ-45 receptacle connector, sides of the plug connector 20 will outwardly press the connecting arms 42 of the anti-mismating latches 4, whereby the free ends of the baffles 44, which originally extended into the receiving space 10, will now be pushed aside to be completely received within the recesses 14, respectively. Therefore, the RJ-45 plug connector 20 can be fully inserted into the receiving space 10 of the insulative housing 1 to electrically connect with the terminals 3.

Figure 7:
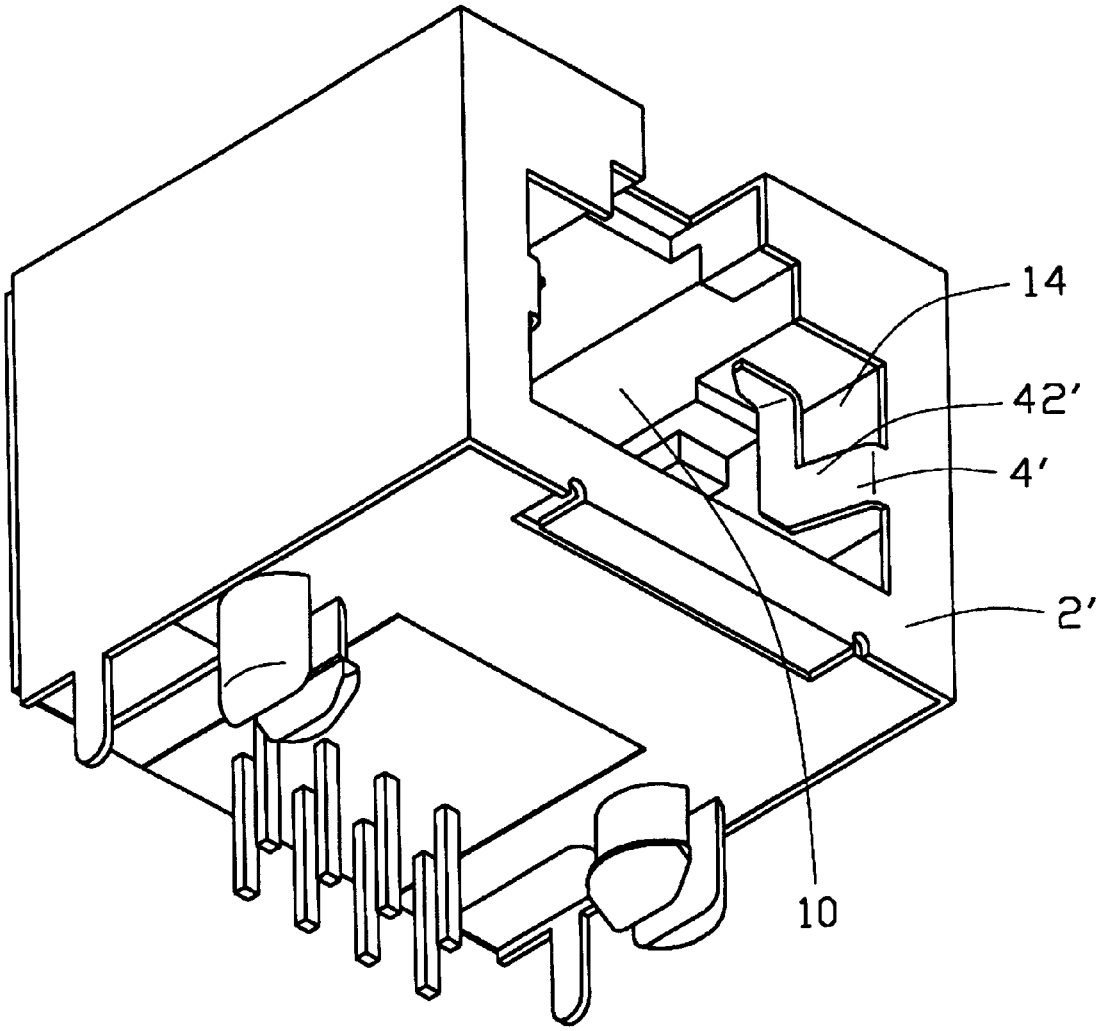
FIG. 7 is a perspective view of a receptacle connector having a pair of anti-mismating latches in accordance with a second embodiment of the present invention.
Figure 8:
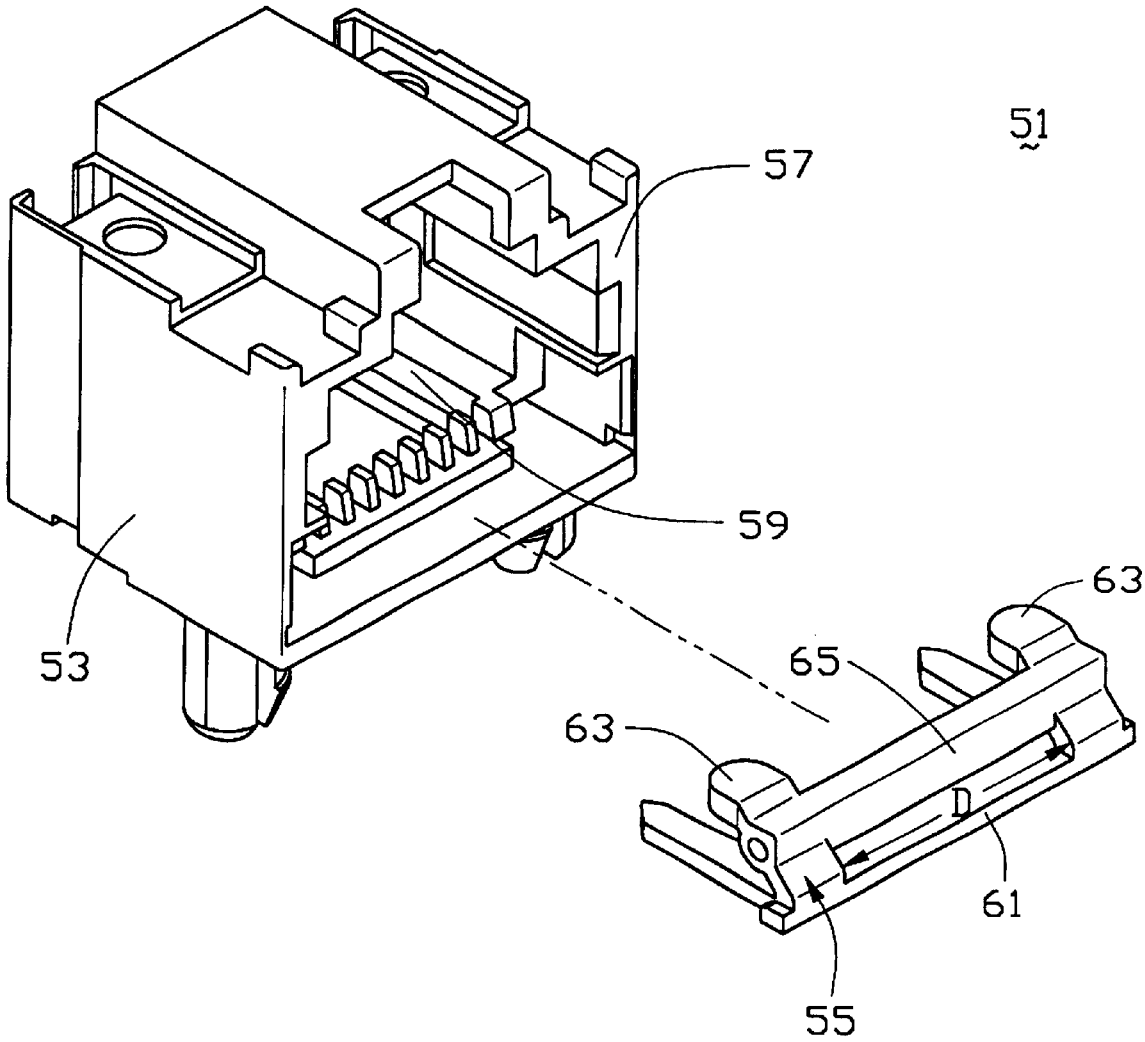
FIG. 8 (RELATED ART)
FIG. 8 is an exploded view of a receptacle connector having an anti-mismating device in accordance with U.S. patent application Ser. No. 09/536,165.

FIG. 7 shows a second embodiment of the present invention. In contrast to the first embodiment, the anti-mismating latches 4' of the second embodiment are integral with the shell 2'. This design reduces the number of the connector parts, and cuts production costs. In this embodiment, the connecting arm 42' is formed on an inner edge of an opening in a front face of the shell 2' adjoining the recess 14. This embodiment requires no slots 12 formed in the insulative housing 1, nor separately formed anti-mismating latches 4, as is required for the first embodiment. Assembly is less complex and manufacture is cheaper.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle connector comprising:

an insulative housing having a mating face, an upper wall, and two opposite sidewalls extending rearward from the mating face and a receiving space defined therebetween for receiving an inserted complimentary plug connector, said upper wall defining a passageway, and each sidewall defining a recess;

a plurality of terminals each having a contacting section received in the receiving space for electrically connecting with the plug connector, and a soldering section at an opposite end for soldering to a printed circuit board; and an anti-mismating means for assembly to at least one of the opposite side walls of the insulative housing, the anti-mismating means including at least one base portion engaging with the insulative housing, at least one resilient arm extending from each base portion and positioned in a corresponding recess of the at least one of the opposite side walls, and at least one baffle further projecting from each resilient arm and into said receiving space;

a slot is defined in the at least one of the opposite side walls adjacent to the recess of the at least one of the opposite side walls and the base portion of the anti-mismating means is inserted into the slot and has an interferential fit with the slot for securely fixing the anti-mismating means in the housing;

wherein said receiving space, said passageway, and said two recesses are in communication with each other and integrally form a space for the complementary plug connector; and wherein during mating, the inserted complementary plug connector presses the at least one resilient arm to cause the at least one baffle to be retracted from the receiving space, thereby allowing the complementary plug connector to be fully inserted into the receiving space of the receptacle connector.

2. The receptacle connector as claimed in claim 1, wherein during mating of the receptacle connector with the complementary plug connector, a free end of the baffle is retracted from the receiving space into the recess of the at least one of the opposite side walls thereby allowing the complementary plug connector to be fully inserted into receiving space of the receptacle connector.

3. The receptacle connector as claimed in claim 1, wherein a shell encloses the insulative housing.

4. A receptacle connector for mating with a complementary plug connector, comprising:

an insulative housing having an upper wall, and two sidewalls and defining a receiving space therebetween, a passageway being defined in the upper wall and a recess being defined in each of the sidewalls;

an anti-mismating means having at least one device, each device having a first section located in the corresponding recess, and a second section extending from the first section into the receiving space;

an electrically conductive shell encloses the insulative housing and the anti-mismating means extends from the shell; and wherein, during mating, the plug connector presses against each first section causing the corresponding second section to retract from the receiving space into the corresponding recess allowing entrance of the plug connector into the receiving space of the receptacle connector.

5. The receptacle connector as claimed in claim 4, wherein the anti-mismating means is in the form of a pair of devices and each device is a latch.

6. A modular jack connector for mating with is complementary modular plug connector, comprising:

a dielectric housing having an upper wall and two sidewalls, and defining a receiving space therebetween for receiving the modular plug connector therein, a passageway and a recess being defining in the upper wall and in one sidewall, respectively; and a means for preventing the modular jack connector from mating with a non-complementary modular plug connector, comprising: a resilient arm extending into the recess of the sidewall; and a baffle extending from the resilient arm and into the receiving space of the insulative housing; and an electrically conductive shell enclosing the dielectric housing, the resilient arm being integrally formed with the shell as a one-piece structure.

7. The modular jack connector in accordance with claim 6, wherein the shell has a front portion and the resilient arm extends rearwardly from an edge of the front portion of the shell adjoining the receiving space.

8. A receptacle connector comprising:

an insulative housing defining a mating face, a receiving space and a passageway above the receiving space;

a plurality of terminals positioned in the housing;

at least a recess positioned beside the passageway and above the receiving space; and an anti-mismating means positioned on one side of the housing, said means including a base portion movably fitting in a slot defined in the one side of the insulative housing neighboring the recess, a resilient arm extending from the base and received within the recess, and a baffle projecting from the resilient arm into the receiving space adjacent to the passageway; wherein said resilient arm to be outwardly laterally deflected by a first plug connector having a larger lateral dimension while being not deflected by a second plug connector having a smaller lateral dimension, and said baffle blocks the receiving space for not allowing entrance of the second plug connector while being moved outwardly laterally by outward deflection of the resilient arm to leave the receiving space for free entrance of the first plug connector.

9. The receptacle connector as described in claim 8, wherein said means is deflectably moveable in a horizontal outward direction by the first plug connector.

10. The receptacle connector as described in claim 8, wherein said resilient arm and said baffle are integrally formed with said anti-mismating means.

11. The receptacle connector as described in claim 8, wherein said recess directly communicates with both the passageway and the receiving space.

* * * * *